United States Patent [19]

Yoldas et al.

[11] Patent Number: 4,770,817

[45] Date of Patent: Sep. 13, 1988

[54] ENCAPSULATION OF SOLIDS IN ALPHA-ALUMINA

[75] Inventors: Bulent E. Yoldas, Churchill; Richard B. Grekila, Pittsburgh, both of Pa.

[73] Assignee: Westinghouse Electric Corp., Pittsburgh, Pa.

[21] Appl. No.: 373,597

[22] Filed: Apr. 30, 1982

[51] Int. Cl.[4] ..... G21F 9/16

[52] U.S. Cl. ..... 252/629; 252/628; 252/626; 252/631; 252/632; 264/0.5; 264/56; 264/65

[58] Field of Search ..... 252/628, 629, 626, 631, 252/632; 264/0.5, 56, 63, 65, 125; 65/18.1, 30.13; 106/1.14, 104

[56] References Cited

U.S. PATENT DOCUMENTS

| | | | |
|---|---|---|---|
| 3,249,551 | 5/1966 | Bixby | 252/629 |
| 3,941,719 | 3/1976 | Yoldas | 252/463 |
| 3,994,822 | 11/1976 | De Bacci et al. | 252/628 |
| 4,012,337 | 3/1977 | Mitchell, III | 252/439 |
| 4,087,375 | 5/1978 | Tanno | 252/629 |
| 4,094,690 | 6/1978 | Morton | 264/0.5 |
| 4,156,658 | 5/1979 | Mercer, Jr. et al. | 405/128 |
| 4,172,807 | 10/1979 | Larker | 264/0.5 |
| 4,204,975 | 5/1980 | Thiele | 252/628 |
| 4,290,847 | 9/1981 | Johnson et al. | 252/636 |
| 4,312,774 | 1/1982 | Macedo et al. | 252/629 |
| 4,387,085 | 6/1983 | Fanelli et al. | 423/630 |

FOREIGN PATENT DOCUMENTS

| | | | |
|---|---|---|---|
| 2717389 | 11/1978 | Fed. Rep. of Germany | 252/628 |
| 1446016 | 7/1974 | United Kingdom | 252/628 |
| 1435855 | 5/1976 | United Kingdom . | |
| 2025685 | 1/1980 | United Kingdom . | |

OTHER PUBLICATIONS

Yoldas, B. 1975, A Transparent Porous Alumina, American Ceramic Society Bulletin 54(3): 286–288.

*Primary Examiner*—John F. Terapane
*Assistant Examiner*—Howard J. Locker
*Attorney, Agent, or Firm*—Joyce L. Morrison; Richard D. Fuerle

[57] ABSTRACT

Disclosed is a method of encapsulating soluble or colloid solids in $\alpha$-alumina by forming a solution or colloid of the solids in a liquid which has a surface tension low enough to wet a non-particulate transition alumina which has a porosity of at least 40%. The solution or colloid is permitted to impregnate the pores of the alumina and the liquid is evaporated. The alumina is then heated to its $\alpha$-$Al_2O_3$ transformation temperature to entrap waste in its matrix and seal the pores. After the alumina has cooled, the surface of the alumina can be washed to remove any solids which were not trapped in the pores.

6 Claims, No Drawings

ENCAPSULATION OF SOLIDS IN ALPHA-ALUMINA

BACKGROUND OF THE INVENTION

A formidable impediment to the widespread use of nuclear power is concern over the safe disposal of nuclear waste products. While a great many proposals have been advanced for sealing these products in various glasses and other types of materials, many of these processes are expensive and do not utilize materials of great long-term stability and resistance to leaching by subsurface water.

A particularly desirable material for the storage of radioactive waste is α-alumina. This material is extremely stable and resistant to chemical attack and physical erosion. The difficulty in using it, however, is that it melts at a very high temperature and other materials have a low solubility in it. Radioactive materials cannot be easily processed at high temperatures because some of them can volatilize and may escape into the atmosphere unless great care is exercised.

SUMMARY OF THE INVENTION

We have discovered that radioactive waste and other solids which are dissolved in a liquid or formed into a colloid, can be sealed in an α-alumina matrix. The method makes use of a special $Al_2O_3$ which has a large open porosity and which non-destructively converts to α-$Al_2O_3$ at 1200° C. by elimination of its entire porosity. The waste products are impregnated in the pores of this $Al_2O_3$ initially, then the material is converted to α-$Al_2O_3$, trapping and encapsulating the waste. Unlike prior processes for encapsulating radioactive waste material, this invention is a low temperature process requiring no thermal reaction of $Al_2O_3$ with the waste material to form a stable crystalline or glassy phase with $Al_2O_3$, nor does it require solubility of the waste material in alumina. It is also a simple and inexpensive process. The invention utilizes aluminum oxide, one of the best materials for containing radioactive waste, yet is able to seal the waste at a much lower temperature than the melting point of the aluminum oxide.

PRIOR ART

U.S. Pat. No. 3,941,719 discloses the preparation of non-particulate transition alumina having a porosity of about 63%.

An article by Bulent E. Yoldas entitled, "A Transparent Porous Alumina," in The American Ceramic Society Bulletin, Vol. 54, No. 3, March, 1975, describes a non-particulate transition alumina having a porosity of about 63%.

U.S. Pat. No. 4,012,337 discloses a process of forming α-alumina compositions from hydrated β-alumina. The α-alumina is used as a support for catalyst compositions.

U.S. Pat. No. 4,156,658 discloses a method for fixing radioactive ions in a porous media by injecting into the porous media a water-soluble organic monomer which is polymerizable to a gel structure with an ion exchange site. The monomer is polymerized to form ion exchange gels.

DESCRIPTION OF THE INVENTION

This invention utilizes a non-particulate transition alumina. The alumina usually has a delta structure, though other crystalline structures could also be used as long as they are not alpha. The alumina has a porosity of at least 40%, and preferably the porosity exceeds 60%. Preparation of the preferred, high porosity alumina is described in U.S. Pat. No. 3,941,719, herein incorporated by reference. Additional descriptions of the preferred alumina can be found in an article by Bulent E. Yoldas entitled "A Transparent Porous Alumina," which appeared in The American Ceramic Soc. Bulletin Vol. 54, No. 3, March, 1975 pp. 286–289 and "Alumina Gels That Form Porous Transport $Al_2O_3$," in The American Ceramic Society Bulletin, Vol. 54, No. 3, March, 1975, pp. 289–290, also herein incorporated by reference, and an article by Bulent E. Yoldas entitled "Alumina Sol Preparation from Alkoxides," which appeared in the Journal of Materials Science, Vol. 10, 1975, pp. 1856–1860. In the preferred alumina, all the porosity is open and consist of channels around 100Å in diameter. Another unusual property of this $Al_2O_3$ is that it goes under crystalline transformations at 1200° C., during which the open structure non-destructively collapses to a dense and virtually pore free α-$Al_2O_3$. The alumina may be used as a solid block material but it is preferably prepared as gravel-sized pieces because the absorption into the alumina of the solution containing the dissolved or colloidal solids is faster when smaller pieces are used.

A solution or colloid is prepared of the solid material one wishes to entrap in the alumina. The solids may be radioactive waste materials, poisons, corrosive substances, or other types of solids. If a colloid is prepared, the colloidal solids must be smaller than the pore sizes of the alumina. The solids in the solution or colloid should thermally decompose to insoluble stable components, such as to oxides, upon heating and should have a low vapor pressure below 1200° C. so that they are not vaporized when the pores are sealed.

The liquid used to form the solution or colloid must have a surface tension which is low enough to wet the alumina so that the liquid flows into the pores of the alumina. The liquid must also be capable of either dissolving the solid material or else of forming a colloid with it. It is preferable that the liquid be inexpensive and non-toxic to hold down material and processing costs. A liquid with a low heat of vaporization is also desirable to reduce the amount of energy needed to evaporate it. Suitable liquids include water, alcohols, and various organic solvents. Water is a desirable liquid because it is inexpensive and many solids are soluble in it. Alcohols to $C_4$ are desirable because of their fluidity and wetting characteristics.

The solution may be prepared at almost any concentration even though saturated solutions are desirable, melts of 100% waste products should be avoided as some shrinkage of the alumina is needed to seal its pores. This is usually not a problem, however, as most solutions become saturated at concentrations considerably below 100% and many solids decompose to give off gases at temperatures below the alumina transformation temperature, which reduces the volume of solids remaining. It is preferable to soak the alumina in the solution or colloid under vacuum in order to remove entrapped air from the alumina. It is also very helpful to heat the solution as this reduces the surface tension of the solution and produces a more rapid and complete penetration of the solution into the pores of the alumina.

Once the pores of the alumina have been filled with the solution or colloid, the carrier liquid or solvent is evaporated by drying, leaving the waste material deposited in the $Al_2O_3$ pores. The alumina is then further heated to its transformation temperature, which is usually about 1200° to about 1250° C., which converts the alumina to α-alumina with collapsing of the entire porosity. This shrinks the alumina and seals its pores, trapping the solid material inside the closed pores. Because the surface nucleation takes place throughout the matrix, the shrinkage does not result in the cracking of the alumina. The conversion to α-alumina is readily observed because the alumina goes from a translucient or transparent state to an opaque, white china color, and up to 20% shrinkage may occur.

After the alumina has cooled, it is desirable to wash the surface to remove any solids which have not been trapped in the pores. These solids can then be added to the solution or colloid used in the next batch.

The following examples further illustrate this invention.

EXAMPLE

In this example, 10 gram, one-piece samples of 64% porous δ-alumina prepared according to U.S. Pat. No. 3,941,719 were soaked overnight in aqueous saturated solutions of various salts. The samples were then removed from these solution, surface dried with a tissue, and heated to 130° C. until dry. The samples were weighed, then heated to 1200° C. for a few minutes until they changed from the translucient or transparent δ-alumina to the opaque α-alumina. The samples were then cooled, washed, dried, and weighed a second time. The following table gives the salts which were used and the percent weight gain of the alumina before and after conversion to α-alumina.

| | | Weight Gain | |
|---|---|---|---|
| Sample | Impregnating Salt | After Impregnation and Drying at 130° C. | After Conversion to α-alumina |
| 1 | $NaNO_3$ | 26.8 | 6.6 |
| 2 | NaOH | 12.5 | 3.3 |
| 3 | NaCl | 22.6 | 7.1 |
| 4 | $Zn(C_2H_3O_2)_2$ | 14.8 | 4.3 |
| 5 | $CuSO_4$ | 23.9 | 4.9 |
| 6 | $KH_2PO_4$ | 41.0 | 34.0 |

The solution containing the potassium dihydrogen phosphate had been heated to about 50° C. during impregnation which indicates that larger amounts of solids may be contained in the alumina if the solutions are heated.

We claim:

1. A method of encapsulating radioactive wastes in α-alumina comprising
   (A) forming a solution or colloid of said radioactive wastes in a liquid that has a surface tension low enough to wet gravel-sized pieces of a porous δ-alumina having at least 40% porosity;
   (B) permitting said solution or colloid to enter the pores of gravel-sized pieces of δ-alumina;
   (C) evaporating said liquid;
   (D) heating said gravel-sized pieces of δ-alumina to their alpha-alumina transformation temperature to seal said pores, thereby entrapping said radioactive wastes therein; and
   (E) after said heating, washing the surface of said gravel-sized pieces to remove radioactive wastes not trapped in said pores.

2. A method according to claim 1 wherein said transformation temperature is about 1200° to about 1250° C.

3. A method according to claim 1 wherein a solution is formed.

4. A method according to claim 1 wherein said liquid is water.

5. A method according to claim 1 wherein said liquid is an alcohol having up to 4 carbon atoms.

6. A method according to claim 1 wherein said solution is heated below its boiling point to increase the speed and extent of its penetration into said pores.

* * * * *